US007868818B2

(12) United States Patent
Henderson

(10) Patent No.: US 7,868,818 B2
(45) Date of Patent: Jan. 11, 2011

(54) MULTI-ELEMENT ANTENNA

(75) Inventor: Robert Ian Henderson, Chelmsford (GB)

(73) Assignee: BAE Systems, PLC, Hampshire (GB)

( * ) Notice: Subject to any disclaimer, the term of this patent is extended or adjusted under 35 U.S.C. 154(b) by 0 days.

(21) Appl. No.: 12/067,123

(22) PCT Filed: Nov. 29, 2007

(86) PCT No.: PCT/GB2007/050727

§ 371 (c)(1),
(2), (4) Date: Mar. 17, 2008

(87) PCT Pub. No.: WO2008/075093

PCT Pub. Date: Jun. 26, 2008

(65) Prior Publication Data

US 2010/0060513 A1 Mar. 11, 2010

(51) Int. Cl.

| | |
|---|---|
| ***H01Q 3/24*** | (2006.01) |
| ***H01Q 9/36*** | (2006.01) |
| ***H01Q 25/02*** | (2006.01) |
| *H01Q 1/28* | (2006.01) |
| *H01Q 9/00* | (2006.01) |

(52) U.S. Cl. ..... 342/175; 342/29; 342/73; 342/74; 342/75; 342/80; 342/147; 342/149; 342/368; 342/374; 343/749; 343/872; 343/700 MS

(58) Field of Classification Search ..... 342/29–51, 342/175, 73–81, 147–158, 350, 385, 417, 342/422, 427, 368–377, 378–384; 343/749–755, 343/792.5, 832–840, 845–849, 874, 875, 343/878–893, 907, 912–916, 700 MS, 872, 343/873, 725, 790

See application file for complete search history.

(56) References Cited

U.S. PATENT DOCUMENTS

| | | | | |
|---|---|---|---|---|
| 3,334,348 | A * | 8/1967 | Alfano, Jr. | 343/836 |
| 3,380,061 | A * | 4/1968 | Larson et al. | 343/874 |
| 3,384,896 | A * | 5/1968 | Kriz | 343/849 |

(Continued)

FOREIGN PATENT DOCUMENTS

| | | | |
|---|---|---|---|
| EP | 0 989 629 | A | 3/2000 |

(Continued)

OTHER PUBLICATIONS

Lu, J.W. et al., "Multi-Beam switched parasitic antenna embedded in dielectric wireless communications systems", Electronics Letters, vol. 37, No. 14, Jul. 5, 2001.

(Continued)

*Primary Examiner*—Bernarr E Gregory
(74) *Attorney, Agent, or Firm*—Pearl Cohen Zedek Latzer, LLP

(57) ABSTRACT

An antenna is provided, in combination with an associated switch array, the antenna comprising a number of antenna elements mounted above a ground plane for providing coverage over a predetermined range of angles in azimuth using a number of beams. Each of the antenna elements is connected to a switch in the switch array and the switch array is operable to connect selected pairs of the antenna elements to a signal path to thereby generate each of the different beams, at the same time connecting unselected antenna elements to ground.

13 Claims, 4 Drawing Sheets

U.S. PATENT DOCUMENTS

| | | | | | |
|---|---|---|---|---|---|
| 3,419,873 | A | * | 12/1968 | Harris et al. | 343/847 |
| 3,484,787 | A | * | 12/1969 | Vallese | 343/751 |
| 4,313,121 | A | * | 1/1982 | Campbell et al. | 343/790 |
| 4,466,003 | A | * | 8/1984 | Royce | 343/749 |
| 4,700,197 | A | * | 10/1987 | Milne | 343/837 |
| 4,897,664 | A | * | 1/1990 | Killackey et al. | 343/836 |
| 4,939,525 | A | * | 7/1990 | Brunner | 343/750 |
| 5,191,349 | A | * | 3/1993 | Dinsmore et al. | 343/751 |
| 5,479,176 | A | | 12/1995 | Zavrel et al. | |
| 5,767,807 | A | * | 6/1998 | Pritchett | 343/833 |
| 6,859,181 | B2 | * | 2/2005 | Colburn et al. | 343/725 |
| 6,917,341 | B2 | * | 7/2005 | Ishihara et al. | 343/752 |
| 6,956,533 | B2 | * | 10/2005 | Lindenmeier | 343/749 |
| 6,987,493 | B2 | * | 1/2006 | Chen | 343/893 |
| 7,265,727 | B2 | * | 9/2007 | Connor | 343/752 |
| 2002/0036586 | A1 | | 3/2002 | Gothard et al. | |

FOREIGN PATENT DOCUMENTS

| | | | |
|---|---|---|---|
| EP | 0 989 629 | A1 | 3/2000 |
| EP | 1355377 | A2 | 10/2003 |
| GB | 2 355 855 | A | 5/2001 |
| JP | 2001345633 | A | 12/2001 |
| JP | 2003258533 | A | 9/2003 |

OTHER PUBLICATIONS

Preston, Stephanie L. et al., "Base-Station Tracking in Mobile Communications Using a Switched Parasitic Antenna Array", IEEE Transactions on Antennas and Propagation, vol. 46, No. 6, Jun. 6, 1998, pp. 841-844.

Rojas, R.G. et al., "Simulation of the Enhanced Traffic Alert and Collision Avoidance System (TCAS II)", IEEE 1987, pp. 572-575.

Rojas, R.G. et al., "Improved Computer Simulation of the TCAS III Circular Array Mounted on an Aircraft", IEEE 1989, pp. 1200-1203.

Kawakami, Haruo et al., "Characteristics of TCAS Circular Phased Array Antennas for Moment Method", IEEE 1989, pp. 1340-1343.

Sampath, K.S. et al., "Analysis and Simulation of Collision Avoidance TCAS Antennas mounted on Aircraft", IEEE 1991, pp. 948-951.

European Search Report for Application No. EP 06 25 6461, Sep. 24, 2007.

International Search Report for Application No. GB0625557.4, Apr. 23, 2007.

International Search Report for Application No. GB0625564.0, Apr. 24, 2007.

Lu et al., "Multi-Beam Switched Parasitic Antenna Embedded in Dielectric for Wireless Communications Systems", Electronics Letters, vol. 37, No. 14, Jul. 5, 2001, 6 pages.

Preston et al., "Base-Station Tracking in Mobile Communications Using a Switched Parasitic Antenna Array", IEEE Transactions on Antennas and Propagation, vol. 46, No. 6, Jun. 1998, 4 pages.

PCT International Search Report in regards to International Application No. PCT/GB2007/050727. Date of completion: Mar. 13, 2008. 15 pages.

International Preliminary Report on Patentability for International Application No. PCT/GB2007/050727 dated Jul. 2, 2009.

* cited by examiner

MULTI-ELEMENT ANTENNA

CROSS-REFERENCE TO RELATED APPLICATIONS

This application is a National Phase Application of PCT International Application No. PCT/GB2007/050727, International Filing Date 29 Nov. 2007; claiming priority of: GB Patent Application, 0625564.0, filed 21 Dec. 2006; GB Patent Application 0625557.4, filed 21 Dec. 2006; and EP Patent Application 06256461.2, filed 21 Dec. 2006, which are hereby incorporated by reference in their entirety.

BACKGROUND OF THE INVENTION

This invention relates to a multi-element antenna and in particular, but not exclusively, to a multi-element antenna and associated switching arrangement designed for use in a monopulse radar collision avoidance system.

The Traffic alert and Collision Avoidance System (TCAS) is an implementation of the Airborne Collision Avoidance System which is fitted to all aircraft over a certain weight and/or passenger carrying capacity, as mandated by the International Civil Aviation Organisation. A recent implementation of TCAS employs an eight element circular antenna array which is fed through a conventional Butler matrix to generate circular phase modes in the array. The circular modes are phase shifted and combined in a sum/difference hybrid to provide a monopulse radar system with claimed resolution of 2° or better. However, TCAS relies upon the relative phase of two circular modes to detect a potential hazard and as such is sensitive, in certain mounting arrangements, to multipath reflections from parts of a host airframe leading to reduced resolution and potential false alarms.

SUMMARY OF THE INVENTION

From a first aspect the present invention resides in antenna, comprising a plurality of top-loaded monopole antenna elements mounted above a ground plane for providing coverage over a predetermined range of angles in azimuth using a plurality of beams, each antenna element having a base section and a top section, wherein a feed conductor extends from an entry point provided in the base section to connect to a top element positioned at the top section, and the feed conductor is surrounded by and insulated from a hollow cylindrical electrically conducting stem section that extends from the base section, where the stem section connects to the ground plane, to a level proximate to but separated from the top element, in combination with a switch array, wherein at least some of said plurality of antenna elements are connected to switches in said switch array and wherein said switch array is operable to connect selected pairs of said antenna elements to a signal path to thereby generate each of said plurality of beams and to establish a virtual short circuit in respect of unselected antenna elements.

Amongst the design constraints for a collision warning/avoidance system suitable for use with military jet aircraft in particular, are good directionality of the beams emitted by the antenna. This is to avoid unwanted emissions, for example in the backward direction relative to the direction of motion of the aircraft, which might interfere with other systems on board or give away the aircraft's presence or position. The antenna and associated switch array according to this first aspect of the present invention, particularly when used to generate sum and difference beams in a monopulse radar based system, offers particularly good directionality in comparison with prior art arrangements.

The use of top-loaded monopole antenna elements make for a particularly low-profile antenna. Moreover, the design of the antenna feed, in which a feed conductor is surrounded by a hollow cylindrical stem section, enables the input impedance of the antenna element to be set (e.g. to 50 Ohms) by appropriate dimensioning of the inner diameter of the stem section relative to the diameter of the feed conductor, thus forming a quarter-wave transformer. This has the advantage that an external matching transformer for each antenna element is avoided. Furthermore, the inventor in this case has noted that with this antenna element design, in which the top element is effectively fed at the top section of the "stem", there is a slight improvement in the operational bandwidth of the antenna element in comparison with prior art designs.

Preferably, the match to 50 ohms input impedance is achieved when the antenna is driven in a "sum" mode, that is, when two adjacent antenna elements are driven in phase with equal amplitude.

Preferably, at least one of the plurality of antenna elements is a passive reflector element connected permanently to ground and positioned so as to increase the directionality of the antenna within the predetermined range of angles.

In a preferred embodiment, the top element is in the shape of a substantially flat-topped cone.

Preferably, in the switch array, each of the plurality of switches has a first pole connected to a first antenna element and a second pole connected to a second antenna element and the switch is operable to connect alternately the first or second pole to a signal path and the unconnected pole to ground.

In a further preferred embodiment, each switch in the switch array is implemented using PIN diodes. In particular, each switch in the switch array is a band-limited shunt multi-throw switch.

In a further preferred embodiment, the antenna comprises a pentagonal array of five antenna elements clustered around a central sixth element and at least the central sixth element is permanently connected to ground. In order to increase the directionality of the antenna yet further, a further one of the six antenna elements is permanently connected to ground and the remaining four ungrounded antenna elements are connected to the switch array.

In a yet further preferred embodiment, the antenna comprises a square array of four antenna elements for use with the same switch array.

DESCRIPTION OF THE DRAWINGS

The present invention also extends to a collision warning or avoidance system having an antenna, in combination with a switch array, according to preferred embodiments of the present invention outlined above.

Preferred embodiments of the present invention will now be described by way of example only and with reference to the accompanying drawings, of which.

DESCRIPTION OF THE PREFERRED EMBODIMENT

Preferred embodiments of the present invention provide an antenna for use in a monopulse radar collision warning/avoidance system and an associated switching arrangement. The antennae and associated switching arrangements are designed for use in a frequency range of interest, preferably 1020-1100 MHz (the IFF band). The antennae and switching arrangements are designed for use in particular as part of a collision warning/avoidance system for aircraft, although preferred embodiments of the present invention may also be applied to other types of craft with a requirement for collision warning/avoidance, e.g. road vehicles or ships.

An antenna according to a first embodiment of the present invention will now be described with reference to FIG. 1.

Figure 1:
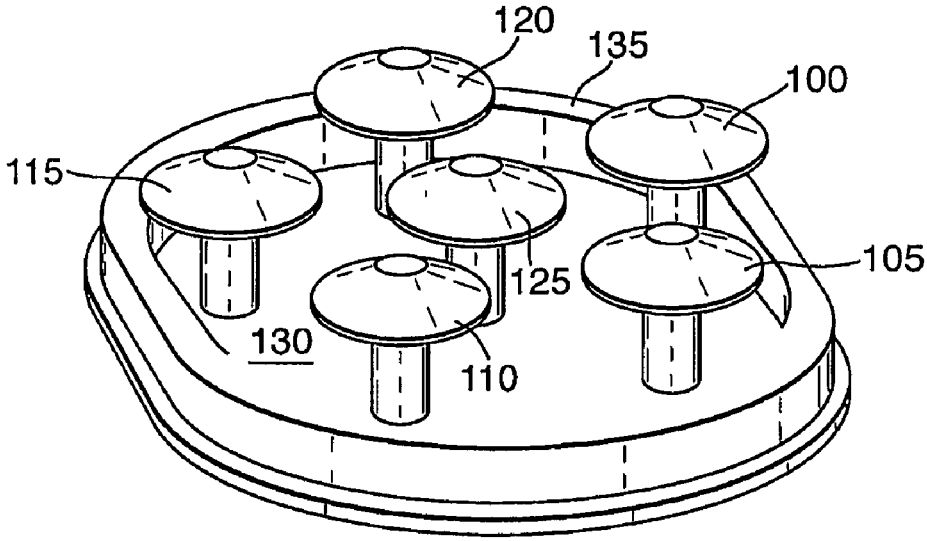
FIG. 1 is a perspective view of an antenna according to a preferred embodiment of the present invention.

Referring to FIG. 1, the antenna comprises a pentagonal array of five antenna elements 100 to 120, surrounding a sixth central antenna element 125. The antenna elements 100-125 are mounted on an oval saddle plate 130 which incorporates a ground plane and which enables the antenna to be mounted conveniently on the outer skin of an aircraft fuselage or of another type of vehicle. A ridge 135 is provided around the saddle plate 130 for attachment of a radome (not shown in FIG. 1) to cover and protect the array of antenna elements 100-125. Alternatively, or in addition to a radome, the antenna elements 100-125 may be embedded in a dielectric foam or other dielectric material whose dielectric properties may be taken into account in the design of the antenna.

Each of the antenna elements 100-125 is a top-loaded monopole (TLM) antenna, selected in particular to minimise the overall height of the antenna. Preferably, the antenna elements 100-125 are spaced 72 mm apart, which is of the order of one quarter-wavelength in the IFF band. Wider element spacing would be desirable, where mounting constraints permit, to help to avoid problems in a feed network arising from the high inter-element coupling. However, space constraints may impose a closer antenna element spacing, of less than one quarter wavelength. In particular, in one application of the present invention, the antenna elements 100-120 are located at points on a radius of 55 mm from the central element 125. Further preferred and advantageous features of the antenna elements 100-125 will be described below.

In order to operate the antenna of this first preferred embodiment of the present invention in a collision warning system, a preferred switching arrangement and method of operation of the switches will now be described with reference to FIG. 2 and further with reference to FIG. 1.

Figure 2:
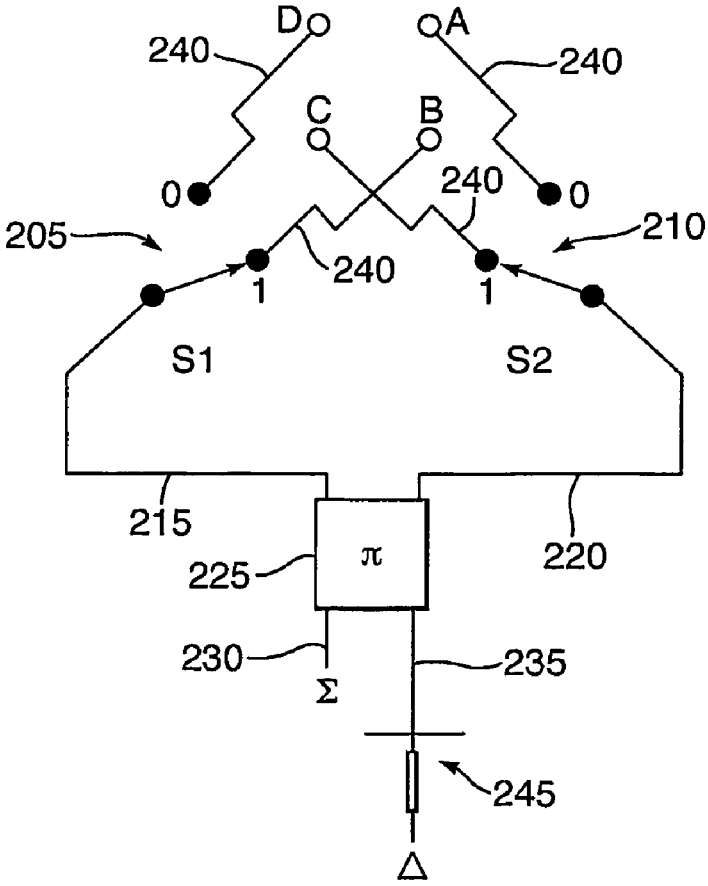
FIG. 2 shows a switching arrangement suitable for use with the antenna of FIG. 1, according to a preferred embodiment of the present invention.

Referring to FIG. 2, a switching arrangement is shown comprising switches 205 and 210, designated S1 and S2 respectively, each operable to switch between two positions designated 0 and 1 to connect respective pairs of switch outputs, selected from switch outputs designated A, B, C and D in FIG. 2, to one of two signal paths 215, 220, in various combinations. The signal paths 215, 220 are linked to a conventional hybrid coupler 225 for coupling sum and difference signal paths 230, 235 respectively to a collision warning/avoidance processor (not shown in FIG. 2).

The switch outputs are linked to four of the antenna elements 100-125 of the antenna so that only those four antenna elements are used actively to transmit or receive signals, the remaining two elements being short-circuited permanently to the ground plane so that they act as passive reflector elements. This has the advantage that the level of back-facing coverage of the antenna is reduced in comparison with the level of generally forward-facing coverage, with respect to the direction of flight of the aircraft carrying the antenna. In practice, a front-to-back ratio of up to 13 dB has been achieved in the coverage with this design.

Preferably the switch output A is connected to the antenna element 100; the switch output B is connected to the antenna element 105; the switch output C is connected to the antenna element 110; and the switch output D is connected to the antenna element 115. Within the switching arrangement, switch 205 (S1) is operable to connect either antenna element 105 (output B) or antenna element 115 (output D) to the input signal path 215, while switch 210 is operable to connect either antenna element 100 (output A) or antenna element 110 (output C) to input signal path 220. Thus, antenna elements 100-115 may be selected in pairs, each pair providing substantially identically-shaped sum and difference beam patterns in three different predetermined directions in azimuth—beam direction being defined in this case as the azimuth of the null in the difference pattern generated by the selected pair of antenna elements—with an appropriate choice of switch positions for switches S1 and S2, as summarised in the following table. In this table, "X" indicates that the switch output and hence the respective antenna element is connected to a signal path, while "-" indicates that the switch output and hence the respective antenna element is shorted to Ground.

| S1 | S2 | Output A (Element 100) | Output B (Element 105) | Output C (Element 110) | Output D (Element 115) | Beam Direction |
|---|---|---|---|---|---|---|
| 0 | 0 | | | | | Not Used |
| 0 | 1 | — | — | X | X | +72° |
| 1 | 0 | X | X | — | — | −72° |
| 1 | 1 | — | X | X | — | 0° |

Each unselected pair of switch outputs are preferably shorted to ground in the switch and the signal path lengths between the switch output and the respective antenna elements are carefully chosen—a multiple of half-wavelengths of the operational signals—to ensure that there is a virtual short circuit present at the unselected antenna elements at each switch combination. The unselected elements therefore act as passive reflectors, so improving the directionality of the beams produced by the corresponding selected pair of antenna elements. In this table, it is assumed that a beam direction of 0° represents a directly forward-facing beam with respect to the host aircraft. In practice, the antenna according to the first embodiment of the present invention provides a total angular coverage in azimuth of at least ±120°.

Preferably, antenna elements 100 and 115 would not be activated together, corresponding to switches S1 and S2 both being in position 0, as the grounded antenna elements 110 and 115 would tend to distort the beam in the forward direction.

As mentioned above, in order to provide the correct reactive load to the antenna elements not selected in a particular switch combination, the lengths of transmission line which connect the antenna elements to the switches must be of the correct length. In particular, where the transmission line stubs 240 within the switching arrangement shown in FIG. 2 represent the entire length of transmission line connecting the switch S1 or S2 to a respective antenna element, the path lengths are equalised and set in length to be a multiple of half-wavelengths of the operational signals. Furthermore, to maintain the correct reactance over a desired frequency band, preferably over the frequency range 1020-1100 MHz, the transmission line lengths between antenna element and switch must be as short as possible, preferably achieved by locating the switching arrangement as close as possible to the antenna.

A preferred design for an antenna element 100-125 will now be described with reference to FIG. 3.

Figure 3:
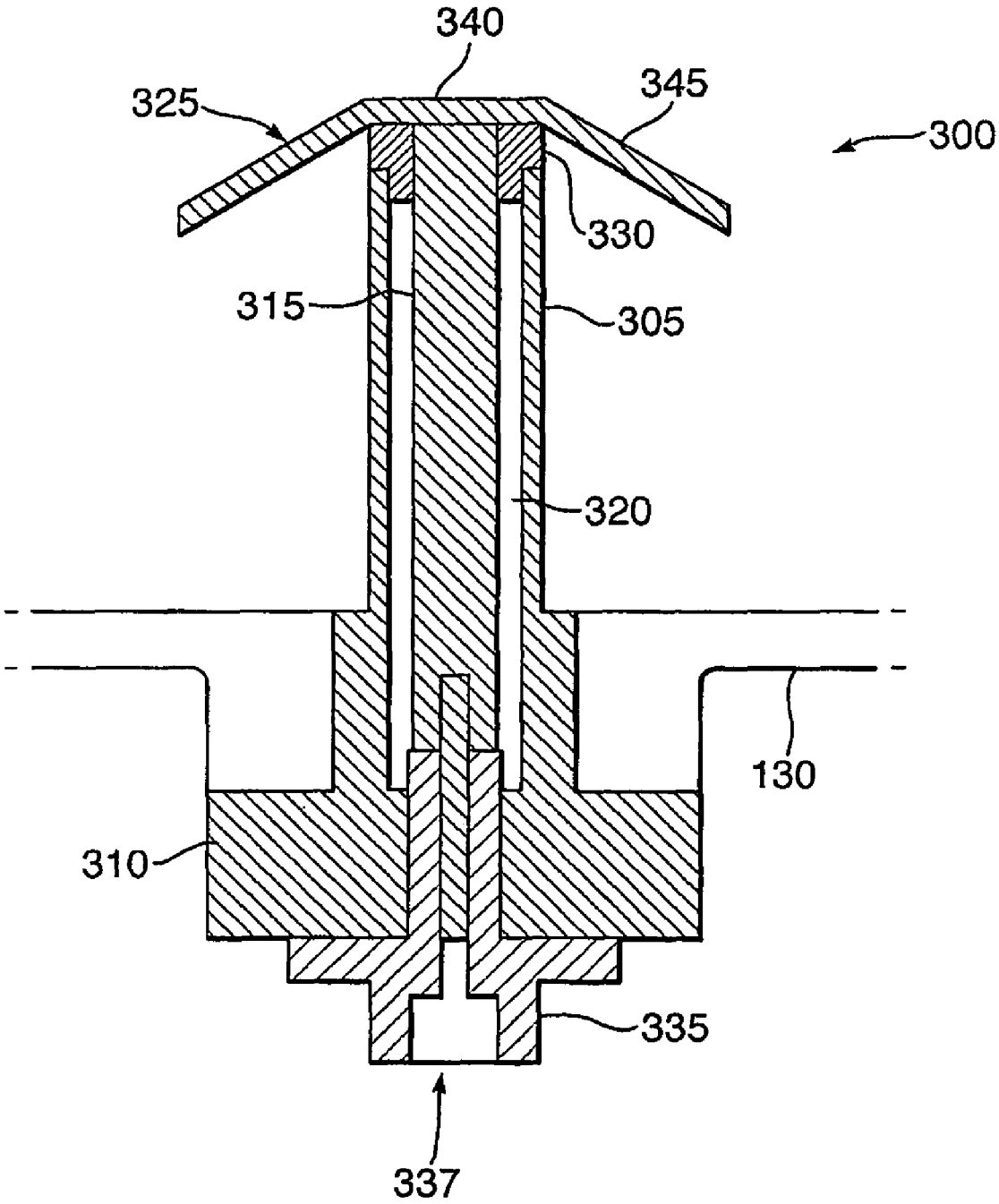
FIG. 3 shows a sectional view through a preferred top-loaded monopole antenna element.

Referring to FIG. 3, a sectional view is provided through a top-loaded monopole antenna element 300. The antenna element 300 is shown comprising a hollow cylindrical metal stem section 305 extending from a base section 310 of the element, the stem section 305 having an electrically conducting feed 315 disposed within it, separated from the inner wall of the stem section 305 by an air gap 320, the feed also extending from within the base section 310 to connect to a flat or, preferably, a conical circular top "plate" element 325, approximately 2 mm thick. The stem section 305 extends to a height of approximately 32 mm above the saddle plate 130. A dielectric "plug" 330 of low dielectric constant ($\in_r$=2) is inserted into the air gap at the open end of the stem section 305 below the top element 325 to maintain a separation between the feed 315 and the inner wall of the stem section 305, and to add sturdiness to the antenna element 300.

A coaxial connector 335 extends through the base section 310 of the antenna element 300 to provide an electrical connection to the feed 315 by means of a conventional coaxial socket 337. The base section 310 of the antenna element 300 is inserted into a hole through the saddle plate 130 from below and secured.

Preferably, the top element 325 comprises a central flat section 340 surrounded by a conical skirt section 345 inclined at approximately 30° below the plane of the flat section 340. This has the advantage over use of an entirely flat top element that the outer antenna elements 100-120 enable a closer-fitting and hence smaller radome to be provided, minimising the overall height and width of the antenna structure.

Preferably the radius of the top element 325 is selected to tune the antenna to substantially the centre frequency in the frequency band of interest, e.g. the IFF band. Preferably, for the IFF band, the radius of the top element 325 is approximately 20 mm. Furthermore, the dimensions of the stem section 305, in particular the radius of the inner and outer conductors of the coaxial transformer formed inside the stem section 325, are selected to ensure that the input impedance of the antenna element 300 of 50 ohms when two adjacent antenna elements 300 are driven in phase with equal amplitude. i.e. in the "sum" mode. However, while a good impedance match is achieved in the "sum" mode, a compromise may be required as regards impedance matching in the "difference" mode, i.e. when two adjacent antenna elements 300 are driven in antiphase. Preferably, the mismatch in the "difference" mode is compensated for by adding matching elements 245, e.g. a matching transformer and matching stubs, in the difference path following the hybrid coupler 225. If preferred, the air gap 320, which is typically only 1 or 2 mm wide, may be filled with a dielectric material of an appropriate dielectric constant, preferably of $\in_r$=2.

Whereas the switching arrangement described functionally above with reference to FIG. 2 may be implemented in one of a number of conventional ways, a preferred implementation of the switching arrangement shown functionally in FIG. 2 will now be described with reference to FIG. 4.

Figure 4:
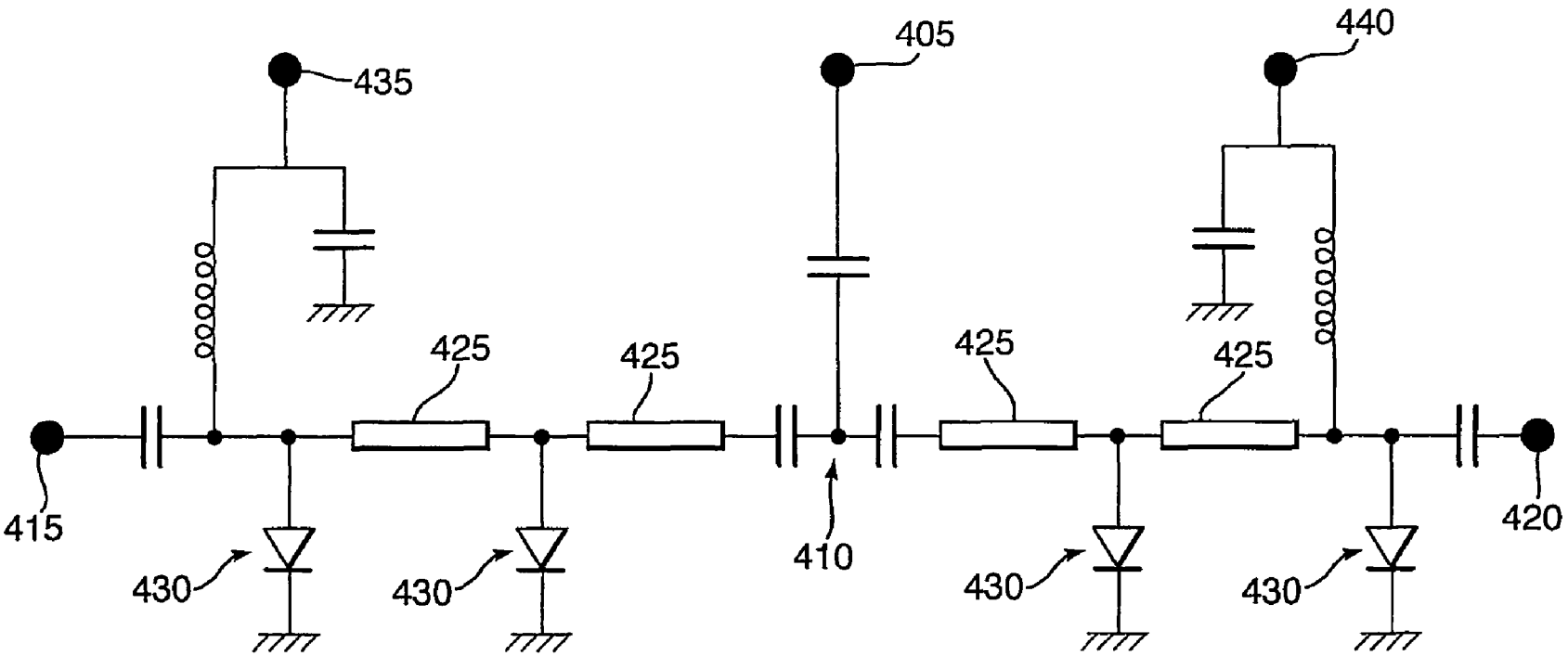
FIG. 4 shows a circuit diagram for a preferred switch, based upon PIN diodes.

Referring to FIG. 4, a circuit diagram is shown for a conventional band-limited shunt multi-throw switch. Two of these switches are required to implement the switching arrangement shown in FIG. 2, one for each of the switches S1 and S2. A common radio frequency (RF) input 405 to the switch would be connected to a signal path 215 or 220 in FIG. 2. The RF input 405 leads to a T-junction 410 where the signal path divides into two separate switchable branches, one branch leading to a first RF output 415 and the other branch to a second RF output 420. Each switchable branch comprises a pair of cascaded quarter-wavelength sections of transmission line 425, each terminated by a shunt PIN (p-type, intrinsic, n-type) diode 430, connected between the end of the respective quarter-wavelength section of transmission line 425 and the ground.

When the switch is in one of its two possible states, the diodes 430 are forward biased in one branch of the switch and reverse biased in the other. The biasing is applied by means of respective bias inputs 435 and 440. Those diodes 430 that are forward biased connect the respective transmission line sections 425 to ground, so forming a quarter wavelength stub with a high impedance. Those diodes 430 that are reverse biased appear effectively as small (unwanted) capacitances. An input (405) RF signal is able to travel along that branch of the switch having the reversed biased diodes 430 to the respective RF output 415 or 420.

Each of the first and second RF outputs 415, 420 is connected to a different antenna element, for example in the configuration described above with reference to FIG. 1 and FIG. 2. As mentioned above with reference to FIG. 2, it is important that a virtual short circuit exists at the points of connection to unselected antenna elements in any given switch setting. This is achieved by ensuring that the path lengths between for example the T-junction 410 in the switch and the respective antenna elements are set to be a multiple of half wavelengths of the operational signals.

In a second preferred embodiment of the present invention, a simpler four element antenna is provided, using the same switching arrangement as used in the first embodiment and as described with reference to FIG. 2. The four element antenna is shown in FIG. 5 and makes use of the same antenna element design as described above with reference to FIG. 3.

Figure 5:
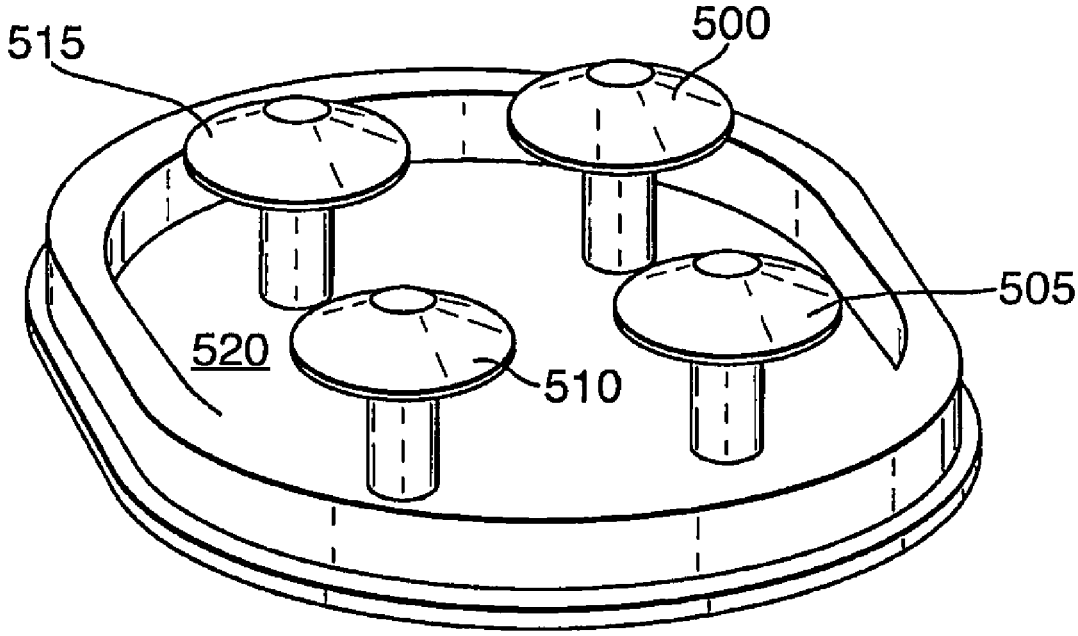
FIG. 5 shows an alternative design of antenna according to a further preferred embodiment of the present invention.

Referring to FIG. 5, the four element antenna comprises a substantially square arrangement of antenna elements 500-515, mounted on a similar oval shaped saddle plate 520 to that (130) used for the antenna in FIG. 1. The antenna elements 500-515 are connected to a similar switching arrangement as that described above with reference to FIG. 2. In particular, the antenna element 500 is connected to the switch output A, the element 505 to the output B, the element 510 to the output C and the element 515 to the output D. Thus the same method may be used to switchably select the antenna elements 500-515 in pairs to generate three sum and difference beams as for the arrangement in the first embodiment above.

The antenna according to this second embodiment of the present invention has the advantage of being a simpler design. However, the ratio of front-to-back coverage is reduced in comparison to the six element design of FIG. 1, being of the order of only 5 dB. This constraint in the performance of the antenna may be of lower significance in systems applied to vehicles or craft other than aircraft.

The invention claimed is:

1. An antenna, comprising a plurality of top-loaded monopole antenna elements mounted above a ground plane for providing coverage over a predetermined range of angles in azimuth using a plurality of beams, each antenna element having a base section and a top section, wherein a feed conductor extends from an entry point provided in the base section to connect to a top element positioned at the top section, and the feed conductor is surrounded by and insulated from a hollow cylindrical electrically conducting stem section that extends from the base section, where the stem section connects to the ground plane, to a level proximate to but separated from the top element, in combination with a switch array, wherein at least some of said plurality of antenna elements are connected to switches in said switch array and wherein said switch array is operable to connect selected pairs of said antenna elements to a signal path to thereby generate each of said plurality of beams and to establish a virtual short circuit in respect of unselected antenna elements.

2. The antenna of claim 1, wherein at least one of said plurality of antenna elements is a passive reflector element connected permanently to ground and positioned so as to increase the directionality of the antenna within said predetermined range of angles.

3. The antenna of claim 1, wherein the top element is in the shape of a substantially flat-topped cone.

4. The antenna of claim 1, wherein the ratio of the inner diameter of the stem section to the diameter of the feed conductor is selected to ensure that the input impedance of the antenna element is substantially 50 ohms.

5. The antenna of claim 1, wherein each of said plurality of switches has a first pole connected to a first antenna element and a second pole connected to a second antenna element and wherein the switch is operable to connect alternately the first or second pole to a signal path and the unconnected pole to ground.

6. The antenna of claim 1, wherein each switch in said array is implemented using PIN diodes.

7. The antenna of claim 6, wherein each switch in said switch array is a band-limited shunt multi-throw switch.

8. The antenna of claim 1, wherein said antenna comprises a pentagonal array of five antenna elements clustered around a central sixth element and wherein at least said central sixth element is a passive reflector element permanently connected to ground.

9. The antenna of claim 8, wherein a further one of said six antenna elements is permanently connected to ground and wherein the remaining four ungrounded elements are connected to said switch array.

10. The antenna of claim 1, wherein said antenna comprises a substantially square array of four antenna elements and each of said four antenna elements is connected to a switch in said switch array.

11. The antenna of claim 1, wherein said multiple beams are sum and difference beams in a monopulse radar system.

12. The antenna of claim 1, wherein said antenna elements are embedded within a dielectric foam material.

13. The antenna of claim 1, further comprising a radome to cover said antenna elements.

* * * * *